US009570088B2

(12) United States Patent
Takahashi

(10) Patent No.: US 9,570,088 B2
(45) Date of Patent: Feb. 14, 2017

(54) SIGNAL PROCESSOR AND METHOD THEREFOR

(71) Applicant: Oki Electric Industry Co., Ltd., Tokyo (JP)

(72) Inventor: Katsuyuki Takahashi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/770,806

(22) PCT Filed: Nov. 20, 2013

(86) PCT No.: PCT/JP2013/081241

§ 371 (c)(1),
(2) Date: Aug. 26, 2015

(87) PCT Pub. No.: WO2014/132499

PCT Pub. Date: Sep. 4, 2014

(65) Prior Publication Data

US 2016/0019906 A1 Jan. 21, 2016

(30) Foreign Application Priority Data

Feb. 26, 2013 (JP) ..... 2013-036331

(51) Int. Cl.

| | |
|---|---|
| ***G10L 21/00*** | (2013.01) |
| ***G10L 21/0208*** | (2013.01) |
| ***G10L 21/0232*** | (2013.01) |
| ***G10L 21/0264*** | (2013.01) |

(52) U.S. Cl.
CPC ..... *G10L 21/0208* (2013.01); *G10L 21/0232* (2013.01); *G10L 21/0264* (2013.01)

(58) Field of Classification Search
CPC ..... H04B 3/23; G10L 21/00
USPC ..... 704/226
See application file for complete search history.

(56) References Cited

U.S. PATENT DOCUMENTS

| | | | | |
|---|---|---|---|---|
| 7,424,463 | B1 * | 9/2008 | Napoletani | G10L 21/0208 706/20 |
| 2003/0061032 | A1 * | 3/2003 | Gonopolskiy | G10L 21/02 704/200.1 |
| 2003/0112967 | A1 * | 6/2003 | Hausman | H04B 3/23 379/417 |
| 2005/0060142 | A1 * | 3/2005 | Visser | G10L 21/0208 704/201 |

(Continued)

FOREIGN PATENT DOCUMENTS

| | | | |
|---|---|---|---|
| JP | H06-274196 | A | 9/1994 |
| JP | 2004-289762 | A | 10/2004 |

(Continued)

*Primary Examiner* — Michael Colucci
(74) *Attorney, Agent, or Firm* — Rabin & Berdo, P.C.

(57) ABSTRACT

A signal processor is configured to suppress a noise component contained in an input voice signal by means of coherence filtering. The processor includes an iterative coherence filtering function for repeatedly conducting the coherence filtering on a signal, which has been subjected to the coherence filtering and then input to the processor again as input signal, and performs the iteration processing on the signal obtained by the coherence filtering until a condition for terminating the iteration is satisfied, thereby preventing musical noise from generating while a noise component is suppressed.

10 Claims, 6 Drawing Sheets

(56) References Cited

U.S. PATENT DOCUMENTS

| | | | | |
|---|---|---|---|---|
| 2006/0111901 | A1* | 5/2006 | Woo | G10L 25/78 704/233 |
| 2007/0005350 | A1* | 1/2007 | Amada | G10L 21/00 704/211 |
| 2009/0022336 | A1* | 1/2009 | Visser | G10L 21/0272 381/94.7 |
| 2010/0254541 | A1* | 10/2010 | Hayakawa | G10L 21/0208 381/71.1 |
| 2012/0045208 | A1* | 2/2012 | Yasuda | H04B 10/60 398/65 |
| 2012/0140946 | A1* | 6/2012 | Yen | H04R 1/1083 381/92 |

FOREIGN PATENT DOCUMENTS

| | | | |
|---|---|---|---|
| JP | 2007-010897 | A | 1/2007 |
| JP | 2008-070878 | A | 3/2008 |
| JP | 2010-286685 | A | 12/2010 |
| JP | 2011-248290 | A | 12/2011 |

* cited by examiner

SIGNAL PROCESSOR AND METHOD THEREFOR

TECHNICAL FIELD

The present invention relates to a signal processor and a method therefor, and more particularly to a telecommunications device and a telecommunications method handling voice signals including acoustic signals on telephone sets, videoconference devices or equivalent.

BACKGROUND ART

As one of solutions for suppressing a noise component included in a captured voice signal, there is a coherence filtering. Japanese patent laid-open publication No. 2008-70878 discloses a coherence filtering method, in which the cross-correlation function of a signal being null in its right and left is multiplied for each frequency, so as to suppress noise components unevenly distributed in its arrival direction.

The coherence filtering is effective at suppressing noise components, but may cause an allophone component, i.e. musical noise, a sort of tonal noise.

SUMMARY OF THE INVENTION

It is an object of the present invention to provide a signal processor and a method therefor, which can suppress a noise component and prevent musical noise from generating in coherence filtering.

A signal processor in accordance with the present invention comprises a filtering processor filtering an input signal containing a noise component by using a coherence filter coefficient to output a filtered signal to thereby suppress the noise component, and further an iteration controller inputting the filtered signal to the filtering processor and iterating the filtering until a condition for terminating the iteration is satisfied.

A signal processing method in accordance with the present invention comprises a step of executing coherence filtering to suppress a noise component contained in an input voice signal, and an iterative coherence filtering step for re-executing the coherence filtering on a signal obtained by the coherence filtering such that the coherence filtering is iterated until a condition for terminating the iteration is satisfied.

The present invention is also implemented in the form of computer program for allowing a computer to serve as the above-described signal processor.

In this way, the present invention provides a signal processor and a method therefor, which can prevent musical noise generation while a noise component is suppressed by coherence filtering.

BRIEF DESCRIPTION OF THE DRAWINGS

The objects and features of the present invention will become more apparent from consideration of the following detailed description taken in conjunction with the accompanying drawings in which.

BEST MODE FOR IMPLEMENTING THE INVENTION

With reference to the accompanying drawings, a detailed description will be made about a signal processor according to a first embodiment of the present invention, in which coherence filtering is repeatedly conducted by iterating the filtering a predetermined number of times.

Figure 1:
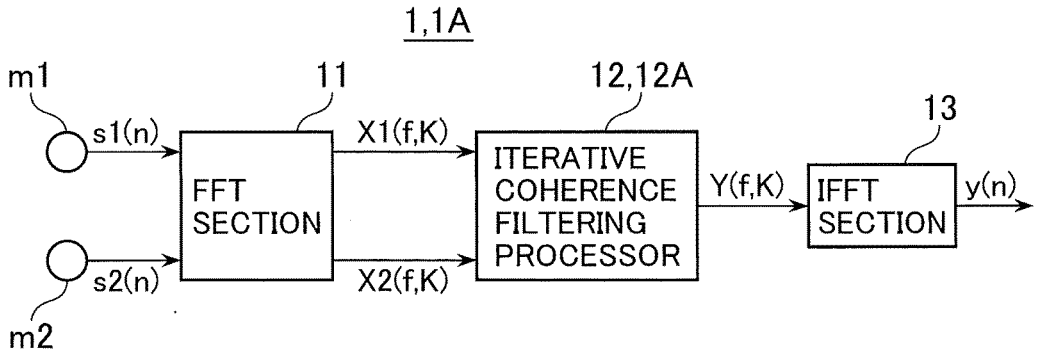
FIG. 1 is a schematic block diagram showing an overall configuration of a signal processor according to an embodiment of the present invention.

FIG. 1 shows in function the illustrative embodiment, which may be implemented in the form of hardware. Alternatively, the components, other than a pair of microphones m1 and m2, can be implemented by software, such as signal processing program sequences, which run on a central processing unit (CPU) included in a processing system such as a computer. In this case, functional components as illustrated in the form of blocks in the figures as if they were implemented in the form of circuitry or devices, may actually be program sequences runnable on a CPU. Such program sequences may be stored in a storage medium and read into a computer so as to run thereon.

As shown in FIG. 1, a signal processor 1 comprises a pair of microphones m1 and m2, a fast Fourier transform (FFT) section 11, an iterative coherence filtering processor 12 and an IFFT section 13.

The pair of microphones m1 and m2 is disposed with a predetermined or given spacing between the microphones m1 and m2 to pick up voices around respective microphones. Voice signals, or input signals, picked up by the microphones m1 and m2 are respectively converted by a corresponding analog-to-digital (AD) converter, not shown, into digital signals s1(n) and s2(n) and in turn sent to the FFT section 11, where n is an index indicative of the order of inputting samples in time sequence, and is presented with a positive integer. In this context, a smaller value of n means an older input sample while a larger value of n means a newer input sample.

The FFT section 11 is configured to receive the series of input signals s1(n) and s2(n) to perform fast Fourier transform, or discrete Fourier transform, on the input signals s1 and s2. Thus, the input signals s1 and s2 can be represented in a frequency domain. When the fast Fourier transform is conducted, the input signals s1(n) and s2(n) are used to set analysis frames FRAME1(K) and FRAME2(K) composed of a predetermined number N of samples. The following Expression (1) presents an example for setting the analysis frame FRAME1(K) from the input signal s1(n), which expression is also applicable to set the analysis frame FRAME2(K). In Expression (1), N is the number of samples and is a positive integer:

$$\text{FRAME } 1(1) = \{s1(1), s1(2), \ldots, s1(i), \ldots, s1(N)\} \quad (1)$$

$$\vdots$$

$$\text{FRAME } 1(K) = \{s1(N \times K + 1), s1(N \times K + 2), \ldots, s1(N \times K + i), \ldots, s1(N \times K + N)\}$$

Note that Kin Expression (1) is an index denoting the frame order which is presented with a positive integer. In this context, a smaller value of K means an older analysis frame while a larger value of K means a newer analysis frame. In addition, an index denoting the latest analysis frame to be analyzed is K unless otherwise specified in the following description.

The FFT section 11 carries out the fast Fourier transform on the input signals for each analysis frame to transform the signals into frequency domain signals X1(f,K) and X2(f,K), thereby supplying the obtained frequency domain signals X1(f,K) and X2(f,K) separately to the iterative coherence filtering processor 12.

Note that f is an index representing a frequency. In addition, X1(f,K) is not a single value, but is formed of spectrum components with several frequencies f1 to fm, as represented by the following Expression (2). Moreover, X1(f,K) is a complex number consisting of a real part and an imaginary part. The same is true of X2(f,K) as well as B1(f,K) and B2(f,K), which will be described later.

$$X1(f,K)=\{X1(f1,K),X1(f2,K), \ldots, X1(fm,K)\} \quad (2)$$

The iterative coherence filtering processor 12 is configured to repeatedly conduct the coherence filtering for predetermined times to obtain a signal Y(f,K), of which noise component is suppressed, and then supplies the obtained signal to the IFFT section 13.

The IFFT section 13 is adapted to perform inverse fast Fourier transform on the noise-suppressed signal Y(f,K) to acquire an output signal y(n), which is a time domain signal.

Figure 2:
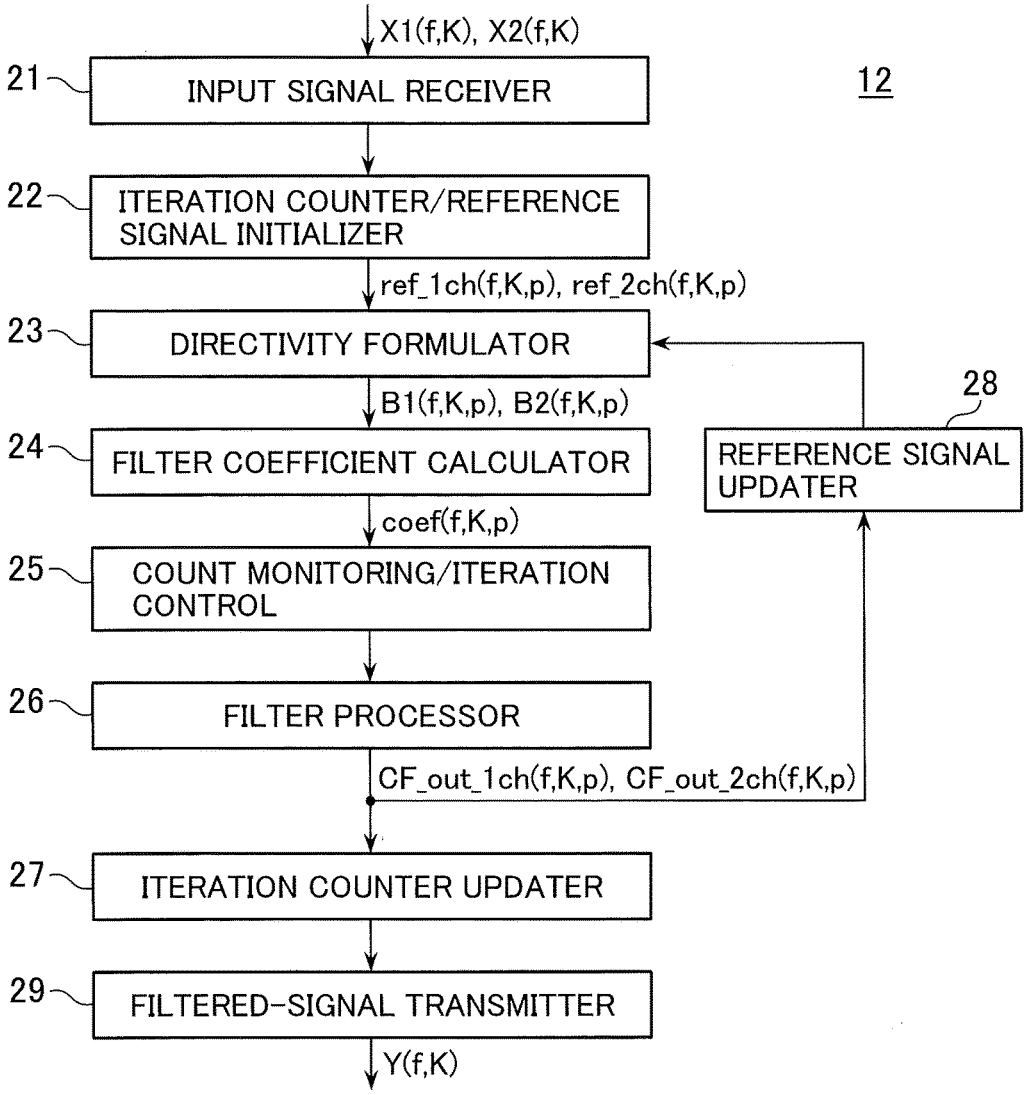
FIG. 2 is a schematic block diagram showing a configuration of an iterative coherence filtering processor according to the embodiment shown in FIG. 1.

As shown in FIG. 2, the iterative coherence filtering processor 12 comprises an input signal receiver 21, an iteration counter/reference signal initializer 22, a directivity formulator 23, a filter coefficient calculator 24, a count monitoring/iteration control 25, a filter processor 26, an iteration counter updater 27, a reference signal updater 28 and a filtered-signal transmitter 29.

In the iterative coherence filtering processor 12, those elements 21 to 29 work together to execute the processes shown in the flowchart in FIG. 5, which will be described later.

The input signal receiver 21 receives the frequency domain signals X1(f,K) and X2(f,K) sent out from the FFT section 11.

The iteration counter/reference signal initializer 22 resets a counter variable p indicative of the number of iterations (hereinafter referred to as iteration counter) and reference signals ref_1ch (f,K,p) and ref_2ch (f,K,p) used for use in calculating a coherence filter coefficient to the initial values thereof. A initial value of the iteration counter p is 0 (zero), and initial values of the reference signals ref_1ch (f,K,p) and ref_2ch (f,K,p) are X1(f,K) and X2(f,K), respectively.

In the notation of the reference signal ref_1ch (f,K,p), the frequency of the signal is f, the frame is the Kth frame, and the number of iterations is p, and 1ch denotes that the reference signal of interest is one of the two reference signals.

The directivity formulator 23 forms two directional signals (a first and a second directional signals) B1(f,K,p) and B2(f,K,p), each having higher directivity in a certain direction. The directional signals B1(f,K,p) and B2(f,K,p) may be formed by applying a known method. For example, a method using the following Expressions (3) and (4) may be applied.

$$B1(f, K, p) = \text{ref_}2ch(f, K, p) - \text{ref_}1\text{ch}(f, K, p) \times \exp\left[-\frac{i2\pi fS}{N}\tau\right] \quad (3)$$

$$B2(f, K, p) = \text{ref_}1ch(f, K, p) - \text{ref_}2\text{ch}(f, K, p) \times \exp\left[-\frac{i2\pi fS}{N}\tau\right] \quad (4)$$

The first directional signal B1(f,K,p) has higher directivity in a certain direction, such as right direction, with respect to a sound source direction (S, FIG. 3A), as will be described later, and the second directional signal B2(f,K,p) has higher directivity in another certain direction, such as left direction in this example, with respect to the sound source direction, as will be described later.

When the iteration of the coherence filtering has never been carried out, the initial values of the reference signals are defined as described above, so that the first and second directional signals B1(f,K,p) and B2(f,K,p) presented with Expressions (3) and (4) are respectively presented by the following Expressions (5) and (6). In these expressions, the frame index K and the iteration counter p are omitted because these elements are not related to the calculation:

$$B1(f) = X2(f) - X1(f) \times \exp\left[-\frac{i2\pi fS}{N}\tau\right] \quad (5)$$

$$B2(f) = X1(f) - X2(f) \times \exp\left[-\frac{i2\pi fS}{N}\tau\right] \quad (6)$$

where S is a sampling frequency, N is the length of an FFT analysis frame, τ is an arrival time difference of a sound wave between the microphones, i is an imaginary unit, and f is a frequency.

Figure 3A:
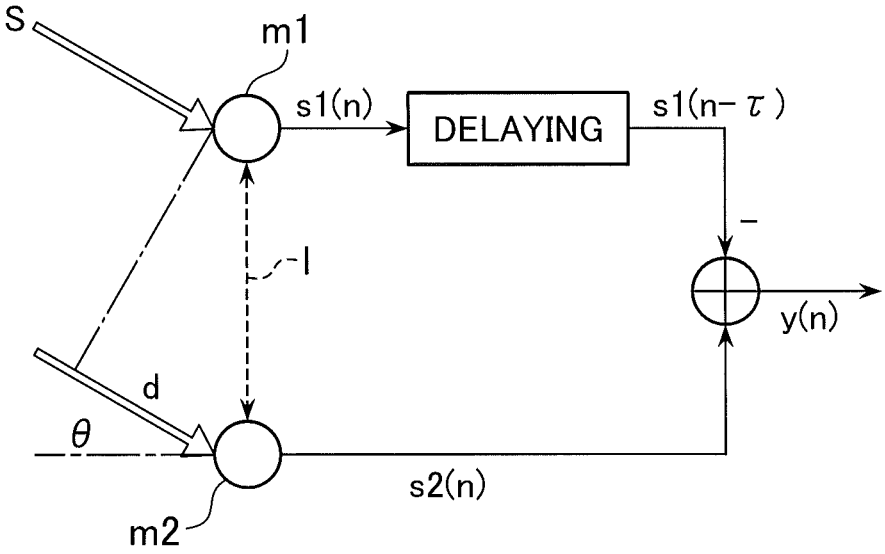
FIGS. 3A and 3B are diagrams for illustrating characteristics of a directional signal transmitted from a directivity formulator according to the embodiment shown in FIG. 2.
Figure 3B:
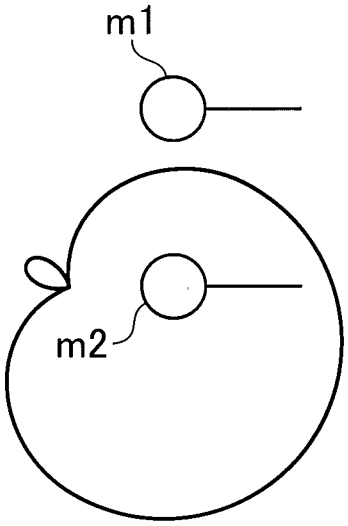

With reference to FIGS. 2 and 3, a description will be made on the formulae for calculating the first and second directional signals B1(f) and B2(f) by taking Expression (5) as an example. By way of example, the sound wave comes from a direction θ shown in FIG. 3A, and is captured by means of the pair of microphones m1 and m2 disposed with a predetermined distance l between them. At this time, a difference in arrival time of the sound wave occurs between the microphones m1 and m2. When a difference in sound path distance is indicated by d, the difference can be expressed by an equation d=l×sin θ, and thus if a sound propagation speed is c, the arrival time difference τ can be given by the following Expression (7):

$$\tau = l \times \sin\theta / c \quad (7)$$

Now, if the input signal s1(n) is given a value of delay τ to obtain a signal s1(t-τ), the obtained signal is equivalent to an input signal s2(t). Thus, a signal y(t)=s2(t)-s1(t-τ) derived by eliminating the difference between those signals is a signal in which sound coming from the direction θ is eliminated. Consequently, the microphone arrays m1 and m2 will have directional characteristics shown in FIG. 3B.

Note that, in the illustrative embodiment, the calculation is made in the time domain. In this regard, a calculation in the frequency domain can also provide the same effect, in which case the aforementioned Expressions (5) and (6) are applied. Assuming that an arrival bearing θ is ±90 degrees.

Figure 4A:
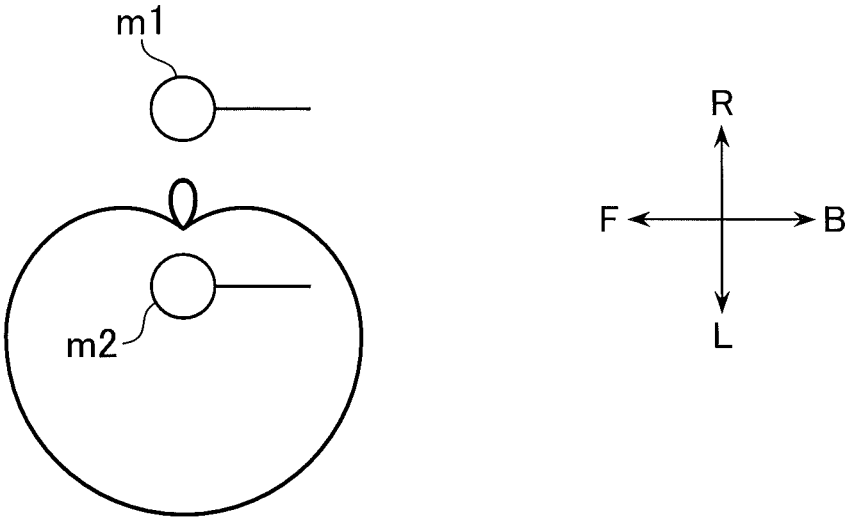
FIGS. 4A and 4B are diagrams for illustrating characteristics of the directional signal produced by the directivity formulator according to the embodiment shown in FIG. 2.
Figure 4B:
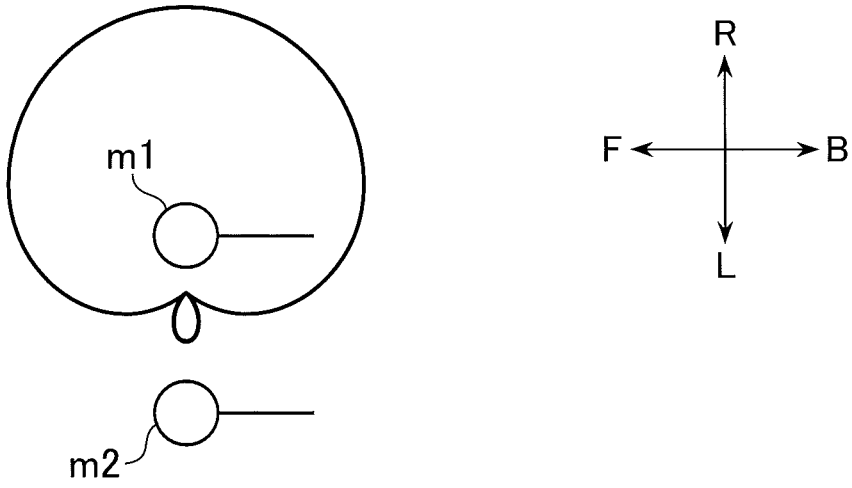

More specifically, the first directional signal B1(f) has higher directivity in a right direction (R) as shown in FIG. 4A whereas the second directional signal B2(f) has higher directivity in a left direction (L) as shown in FIG. 4B. In these figures, F denotes forward, and B denotes backward. From now on, a description will be made on premises that θ is ±90 degrees, but it may not be restricted thereto.

In the coherence filtering conducted iteratively, the reference signals ref_1ch (f,K,p) and ref_2ch (f,K,p) are regarded as input signals to be subjected to the coherence filtering, so that the above Expressions (3) and (4) may be applied.

The filter coefficient calculator 24 calculates a coherence filter coefficient coef(f,K,p) by the following Expression (8) based on the first and second directional signals B1(f,K,p) and B2(f,K,p):

$$\mathrm{coef}(f, K, p) = \frac{|B1(f, K, p) \cdot B2(f, K, p)^*|}{\frac{1}{2}\{|B1(f, K, p)|^2 + |B2(f, K, p)|^2\}} \tag{8}$$

The count monitoring/iteration control 25 compares the iteration counter p with a predetermined maximum iteration value MAX, and controls the components such that if the iteration counter p is smaller than the maximum iteration value MAX, the coherence filtering is executed iteratively, and when the iteration counter p reaches the maximum iteration value MAX, then the coherence filtering is terminated without iterating the processing.

The iteration counter updater 27 increments the iteration counter p by one when the count monitoring/iteration control 25 decides to iterate the coherence filtering. In response to this increment, another sequence of the coherence filtering will be started.

The reference signal updater 28 multiplies, for each frequency component, the input frequency domain signals X1(f,K) and X2(f,K) by the coherence filter coefficient coef(f,K,p) calculated by the filter coefficient calculator 24, as defined by the following Expressions (9) and (10), to thereby obtain filtered signals CF_out_1ch (f,K,p) and CF_out_2ch (f,K,p). The reference signal updater 28 further sets the filtered signals CF_out_1ch (f,K,p) and CF_out_2ch (f,K,p) thus obtained as reference signals Ref_1ch (f,K,p) and Ref_2ch (f,K,p) for the next iteration process, as defined by the following Expressions (11) and (12):

$$CF_\mathrm{out}_1ch(f,K,p)=X1(f,K)\times\mathrm{coef}(f,K,p) \tag{9}$$

$$CF_\mathrm{out}_2ch(f,K,p)=X2(f,K)\times\mathrm{coef}(f,K,p) \tag{10}$$

$$\mathrm{ref}_1ch(f,K,p)=CF_\mathrm{out}_1ch(f,K,p-1) \tag{11}$$

$$\mathrm{ref}_2ch(f,K,p)=CF_\mathrm{out}_2ch(f,K,p-1) \tag{12}$$

The filtered-signal transmitter 29 supplies the IFFT section 13 with either of the filtered signals CF_out_1ch (f,K,p) and CF_out_2ch (f,K,p) obtained at the time when the count monitoring/iteration control 25 decides to terminate the iteration of the coherence filtering, in the form of iterative coherence filtering signal Y(f,K). In addition, the filtered-signal transmitter 29 increments K by one so as to start successive frame processing.

Well, a description will be made about the operation of the signal processor 1 according to the first embodiment by referring to the drawings, that is, firstly about overall operation, and then about a detailed operation conducted in the iterative coherence filtering processor 12.

The signals s1(n) and s2(n) in the time domain input from the pair of microphones m1 and m2 are transformed by the FFT section 11 to the frequency domain signals X1(f,K) and X2(f,K), respectively, which are then sent to the iterative coherence filtering processor 12. The iterative coherence filtering processor 12 in turn repeats the coherence filtering a predetermined number of times (M times), and supplies a noise-suppressed signal Y(f,K) obtained by the filtering to the IFFT section 13.

The IFFT section 13 performs the inverse fast Fourier transform on the noise-suppressed signal Y(f,K), namely frequency domain signal, into a time domain signal y(n), and then sends out the obtained signal y(n).

Next, the detailed operation carried out in the iterative coherence filtering processor 12 will be described with reference to FIG. 5. FIG. 5 shows the processing of a frame, this processing being repeatedly conducted frame-by-frame.

When the frame processing is conducted on a new frame and the frequency domain signals X1(f,K) and X2(f,K) of the new frame, i.e. current frame K, are sent from the FFT section 11, the iterative coherence filtering processor 12 initializes the iteration counter to zero and also the reference signals Ref_1ch (f,K,p) and Ref_2ch (f,K,p) to the frequency domain signals X1(f,K) and X2(f,K), respectively (Step S1).

Subsequently, the first and second directional signals B1(f,K,p) and B2(f,K,p) are calculated on the basis of the reference signals Ref_1ch (f,K,p) and Ref_2ch (f,K,p) by applying Expressions (3) and (4) (Step S2), and in turn the coherence filter coefficient coef(f,K,p) is calculated based on the directional signals B1(f,K,p) and B2(f,K,p) by applying Expression (8) (Step S3).

Then, as represented by Expressions (9) and (10), the input frequency domain signals X1(f,K) and X2(f,K) are respectively multiplied by the coherence filter coefficient coef(f,K,p) for each frequency component to thereby acquire the filtered signals CF_out_1ch (f,K,p) and CF_out_2ch (f,K,p) (Step S4).

Subsequently, the iteration counter p is compared with the predetermined maximum iteration value MAX (Step S5).

If the iteration counter p is smaller than the maximum iteration value MAX, the iteration counter p is incremented by one, and the coherence filtering is performed on a new iteration (Step S6). In this case, the previous, filtered signals CF_out_1ch (f,K,p) and CF_out_2ch (f,K,p) are set as reference signals Ref_1ch (f,K,p) and Ref_2ch (f,K,p) for the new iteration (Step S7), and then the operation moves to the above-described Step S2 to perform the calculation of directional signal.

If, on the other hand, the iteration counter p reaches the maximum iteration value MAX, either of the filtered signals CF_out_1ch (f,K,p) and CF_out_2ch (f,K,p), which can be acquired at that time, is supplied as the iterative coherence filtering signal Y(f,K) to the IFFT section 13 while the frame variable K is incremented by one (Step S8), and the processing will be performed on a subsequent frame.

According to the first embodiment, a filter coefficient is estimated again from a signal on which coherence filtering is conducted, and is given to an input signal to iterate the coherence filtering a certain number of times. As a consequence, a noise component can be suppressed in accordance with coherence filtering while preventing generation of musical noise.

Thus, the signal processor according to the first embodiment can be applied to a telecommunications device, such as a videoconference system, cellular phone, smartphone and similar, so as to improve the sound quality on telephonic speech.

Next, with reference to the drawings, a detailed description will be made on a signal processor, and method and program for signal processing in accordance with a second embodiment of the present invention, in which a predetermined number of iterations repeatedly executing the iterative coherence filtering is optimally controlled.

In the first embodiment, the number of iterations of coherence filtering is not variable. However, the optimal number of iterations depends on noise characteristics. Hence, if the number of iterations is fixed, the degree of noise suppression could be insufficient. Moreover, there is a possibility of impairing the naturalness of the sound due to the distortion of the sound occurring each time the processing is iterated, so that it would be disadvantageous to unnecessarily increase the number of iterations. In the second embodiment, the optimal number of iterations is defined such that the naturalness of the sound and the suppression are well kept in balance with less distortion and musical noise.

Figure 6:
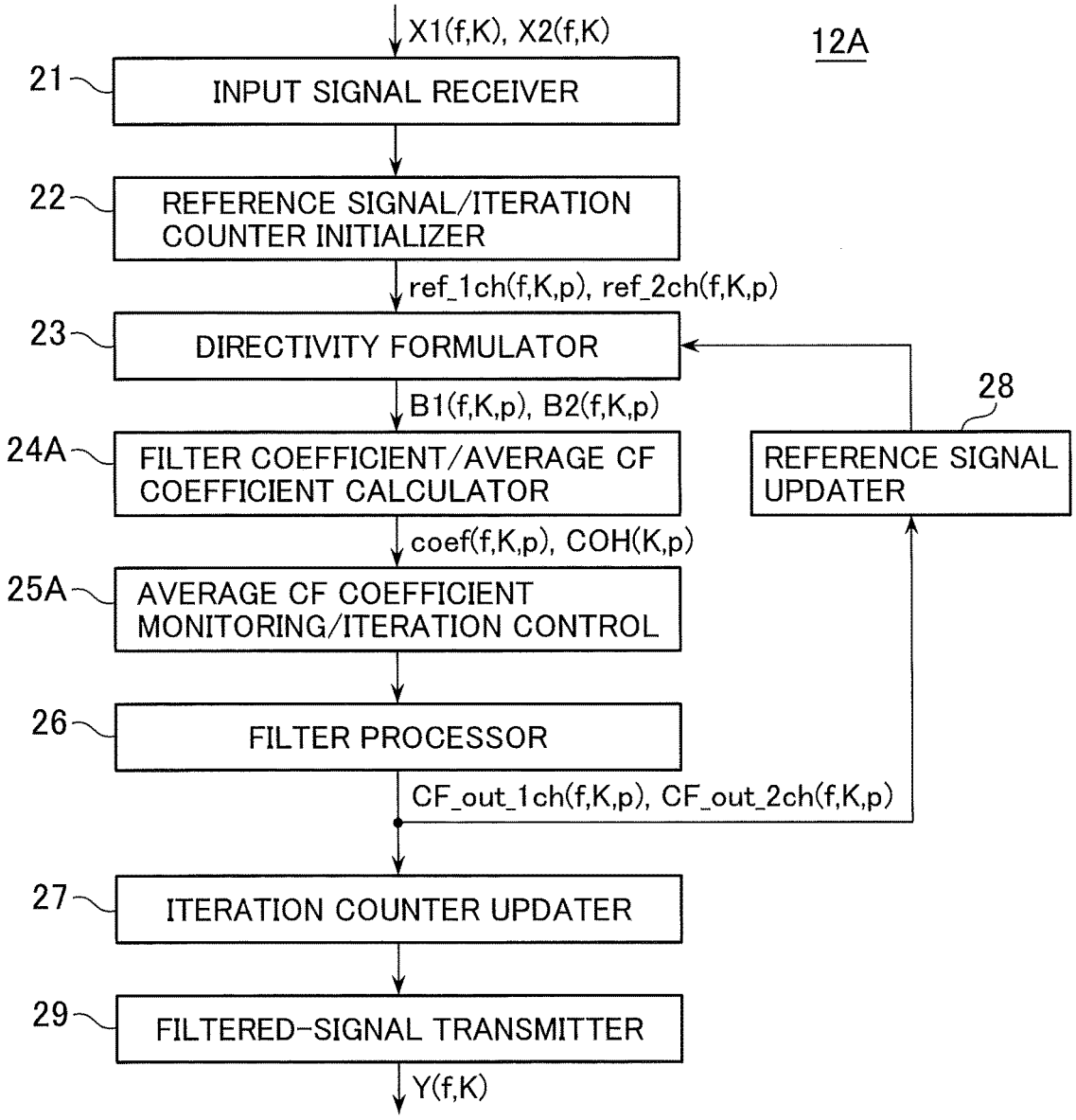
FIG. 6 is a schematic block diagram showing a configuration of another iterative coherence filtering processor according to a second embodiment of the present invention.

The overall configuration of the signal processor 1A in accordance with the second embodiment may be the same as the first embodiment, except that the internal structure of the iterative coherence filtering processor 12A shown in FIG. 1 differs from that of the first embodiment. In FIG. 6, the similar or corresponding parts to those in FIG. 2 are assigned with the same reference numerals as FIG. 2.

The iterative coherence filtering processor 12A in accordance with the second embodiment is different from the iterative coherence filtering processor 12 of the first embodiment in that the processor 12A has a filter coefficient/average coherence filter (CF) coefficient calculator 24A instead of the filter coefficient calculator 24 of the iterative coherence filtering processor 12 of the first embodiment, and also the iteration monitoring/control is replaced by an average CF coefficient monitoring/iteration control 25A, and the remaining elements may be the same as the iterative coherence filtering processor 12 of the first embodiment.

More specifically, the iterative coherence filtering processor 12A in accordance with the second embodiment comprises, in addition to the input signal receiver 21, the iteration counter/reference signal initializer 22, the directivity formulator 23, the filter processor 26, the iteration counter updater 27, the reference signal updater 28 and the filtered-signal transmitter 29, the filter coefficient/average CF coefficient calculator 24A and the average CF coefficient monitoring/iteration control 25A.

The filter coefficient/average CF coefficient calculator 24A is adapted to calculate the coherence filter coefficient coef(f,K,p) based on the first and second directional signals B1(f,K,p) and B2(f,K,p) by applying Expression (8), and further calculate an average value COH(K,p) of the coherence filter coefficients coef(0,K,p) to coef (M1,K,p) for each acquired frequency component by applying the following Expression (13), the average value being hereinafter referred to as average coherence filter coefficient:

$$COH(K, p) = \sum_{f=0}^{M-1} \mathrm{coef}(f, K, p)/M \tag{13}$$

The average CF coefficient monitoring/iteration control 25A is configured to control the components in such a way that an average coherence filter coefficient COH(K,p) in the current iteration is compared with another average coherence filter coefficient COH(K,p−1) in the iteration the one before, and when the average coherence filter coefficient COH(K,p) in the current iteration is greater than the average coherence filter coefficient COH(K,p−1) in the previous iteration, the coherence filtering is further iterated, whereas when the average coherence filter coefficient COH(K,p) in the current iteration does not exceed the average coherence filter coefficient COH (K,p−1) in the previous iteration, then the coherence filtering is not iterated and terminated instead.

In the following, a reason will be described for utilizing the average coherence filter coefficient COH(K,p) to make a determination of termination of the iteration.

Since the coherence filter coefficient coef(f,K,p) is also a cross-correlation function of the signal component being null on the right and left directions, the filter coefficient can be associated with the arrival bearing of an input voice such that when the cross-correlation function is large, the input voice is a voice component arriving from the front where no deviation of the arrival bearing, and when the function is small, the input voice is a voice component of which arrival bearing deviates right or left. Thus, multiplication of the coherence filter coefficient coef(f,K,p) means that a noise component arriving from the side is suppressed, so that a coherence filter coefficient, from which the influence of the component arriving from the side is eliminated, can be obtained by increasing the number of iterations.

When the average coherence filter coefficient COH(K,p), which is a value obtained by averaging the coherence filter coefficient coef(f,K,p) by all frequency components, was calculated in practice according to Expression (13) to determine its behavior, it was confirmed that the average coherence filter coefficient COH(K,p) in a noise interval increased as the number of iterations increased, leading to the decrease of contribution of the components arriving from the side.

However, if the iteration is made more than necessary, the components arriving from the front are also suppressed, resulting in distortion of sound. In this case, the average coherence filter coefficient COH(K,p) decreases because the influence of the components arriving from the front gets lower.

In view of the above-described behavior of the average coherence filter coefficient COH(K,p) according to the number of iterations, it is considered that the number of iterations that allows the average coherence filter coefficient COH(K, p) to take a limit value provides a balance between the suppression capability and the sound quality.

Accordingly, the average coherence filter coefficient COH (K,p) is monitored for each iteration, and when the change, namely behavior, in the average coherence filter coefficient COH(K,p) is turned from increment to decrement, the iteration is terminated, thereby allowing the iterative coherence filtering to be conducted with the optimal number of iterations.

Next, a detailed operation of the iterative coherence filtering processor 12A in the signal processor 1A of the second embodiment will be described with reference to the drawings. It is to be noted that the overall operation of the signal processor 1A of the second embodiment will not be described herein because it may be similar to that of the signal processor 1 of the first embodiment.

Figure 5:
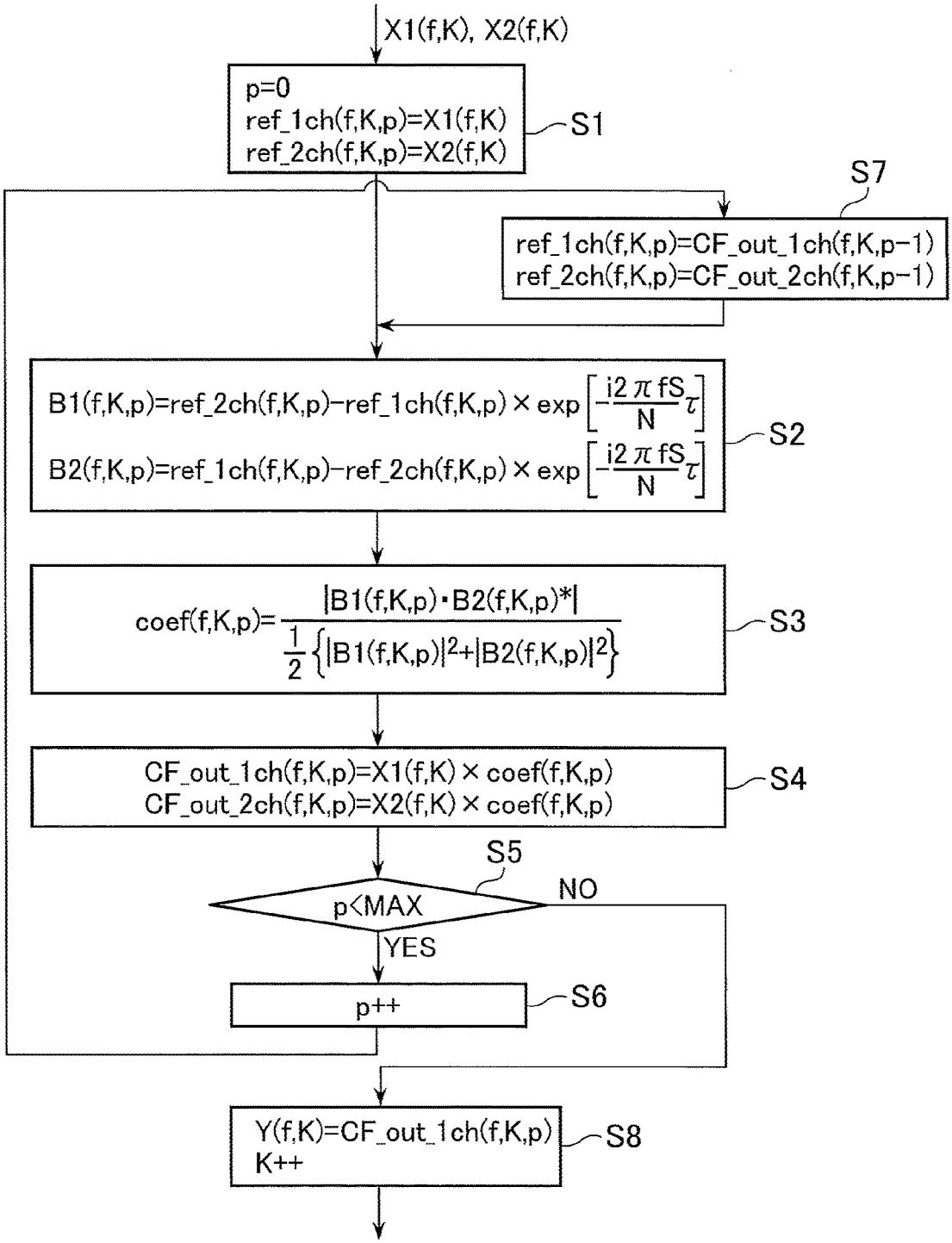
FIG. 5 is a flowchart useful for understanding an operation of the iterative coherence filtering processor according to the embodiment shown in FIG. 1.
Figure 7:
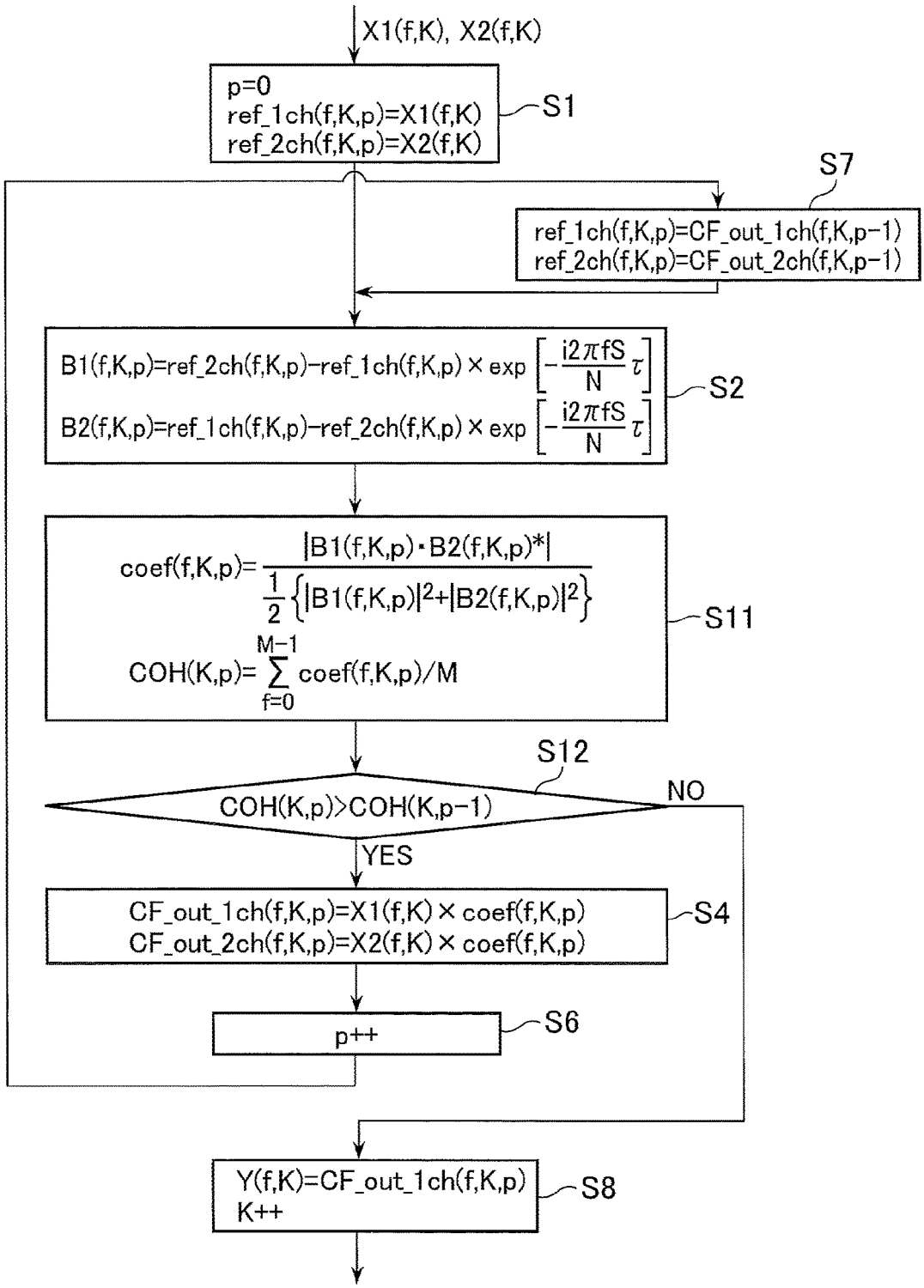
FIG. 7 is a flowchart useful for understanding an operation of the iterative coherence filtering processor according to the embodiment shown in FIG. 6.

In FIG. 7, the operation steps identical to those of the first embodiment shown in FIG. 5 are designated with the same reference numerals as FIG. 5.

When frequency domain signals X1(f,K) and X2(f,K) of a new frame, or current frame K, are supplied, the iteration counter p is initialized to zero while the reference signals Ref_1ch (f,K,p) and Ref_2ch (f,K,p) are initialized to the frequency domain signals X1(f,K) and X2(f,K), respectively (Step S1). Then, on the basis of the reference signals Ref_1ch (f,K,p) and Ref_2ch (f,K,p), the first and second directional signals B1(f,K,p) and B2(f,K,p) are calculated according to Expressions (3) and (4) (Step S2).

By using the directional signals B1(f,K,p) and B2(f,K,p), the coherence filter coefficient coef(f,k,p) is also calculated by means of Expression (8), and the coherence filter coefficients coef(0,K,p) to coef(M-1,K,p) thus obtained for frequency components are used to calculate the average coherence filter coefficient COH(K,p) by applying Expression (13) (Step S11).

Subsequently, a determination is made on whether or not the average coherence filter coefficient COH(K,p) of the current iteration is larger than the average coherence filter coefficient COH(K,p−1) of the previous iteration (Step S12).

If the average coherence filter coefficient COH(K,p) by the current iteration is larger than the average coherence filter coefficient COH(K,p−1) by the previous iteration, the input frequency domain signals X1(f,K) and X2(f,K) are respectively multiplied by the coherence filter coefficient coef(f,K,p) for each frequency component, as can be seen from Expressions (9) and (10), so as to derive the filtered signals CF_out_1ch (f,K,p) and CF_out_2ch (f,K,p) (Step S4). In addition, the iteration counter p is incremented by one, and coherence filtering is newly started with another number of iterations (Step S6), in which filtering the last, filtered signals CF_out_1ch (f,K,p) and CF_out_2ch (f,K,p) are set to the reference signals Ref_1ch (f,K,p) and Ref_2ch (f,K,p) for the current iteration (Step S7), and then the operation moves to the aforementioned Step S2 to calculate the directional signals.

By contrast, if the average coherence filter coefficient COH(K,p) by the current iteration is lower than the average coherence filter coefficient COH(K,p−1) by the iteration the one before, one of the filtered signals CF_out_1ch (f,K,p) and CF_out_2ch (f,K,p), which are obtained at that time, is supplied as the iterative coherence filtering signal Y(f,K) to the IFFT section 13 while the frame variable is incremented by one (Step S8), and the filtering will be performed on a subsequent frame.

According to the second embodiment, the iteration coherence filtering is terminated when the balance between the sound quality and the suppression capability is well kept, where the average coherence filter coefficient turns from increment to decrement, so that the sound quality and the suppression capability can be achieved proportionally.

Consequently, the signal processor of the second embodiment can be applied to a telecommunications device, such as a videoconference system, cellular phone, smartphone and similar, so as to improve the sound quality on telephonic speech.

In the second embodiment, when the average coherence filter coefficient in the current iteration falls below that in the previous iteration once, it is considered that the behavior of the average coherence filter coefficient turns from increment to decrement. Alternatively, the system may be adapted such that if the average coherence filter coefficient in the current iteration continuously falls below that in the previous iteration a certain number of times, e.g. twice, it can determine that the behavior of the average coherence filter coefficient turns from increment to decrement.

In the second embodiment, the iteration is controlled to strike the balance between the suppression capability and the sound quality. Alternatively, the sound quality can be decreased to place much significance on the suppression capability, or the suppression capability may be decreased to put emphasis on the sound quality. In the former case, even after the average coherence filter coefficient starts to decrease, for instance, the iteration process will be continued a predefined number of times. By contrast, in the latter case, for example, a coherence filter coefficient obtained in an iteration performed a predetermined number of times before the current one is stored, and a filtered signal, to which a coherence filter coefficient in an iteration carried out a predefined number of times before an iteration where the average coherence filter coefficient turns to decrement is applied, may be sent out in the form of output signal.

The determination on the termination of the iteration made in the second embodiment is based on the magnitude of the average coherence filter coefficients in the iterations successively taken place. Alternatively, the determination can be made on the basis of an inclination, i.e. differential coefficient, of the average coherence filter coefficients in the iterations successively taken place. If the inclination turns to zero, or within a range of $0\pm\alpha$, where $\alpha$ is a small value sufficient to determine the minimum value, the termination of the iteration is determined. When a difference in calculation times of the average coherence filter coefficients in the iterations conducted successively is constant, the calculation times can be obtained as the average coherence filter coefficients in the iterations successively performed. By contrast, if the difference in the calculation times of the average coherence filter coefficients in the successive iterations is not constant, the time is recorded for each calculation of the average coherence filter coefficient so as to calculate the time by dividing the difference between the average coherence filter coefficients in the successive iterations by the time difference.

The second embodiment utilizes the average coherence filter coefficient to determine whether the iteration is to be terminated, but can instead use other parameters. For example, coherence filter coefficients of median frequency components in the iterations before and after the current iteration are compared with each other to thereby determine if the iteration is continued or terminated. Alternatively, the continuation of the iteration may be determined by comparing the averages for some but not all of the frequency components. Moreover, as representative value for several frequency components, a statistical value other than the average value, such as median value, may be applied.

In the illustrative embodiments, the coherences COH(K,p) and COH(K,p−1) in the iterations before and after a new iteration are compared to one another for each iteration to determine whether or not the iteration is to be continued, but the number of iterations may be defined according to the coherence COH(K) before starting a new iteration. By way of example, relationships between the value of the coherence COH(K) and the number of times the iteration actually conducted are identified by, e.g. a simulation when a timing of the termination of the iteration is defined as in the case of the above-described embodiments, and the relationships thus identified are sorted out to formulate a relational expression between the (range of) coherence and the maximum number of iterations or create a transformation table in advance, and then when a coherence is calculated, the relational expression or the transformation table is applied to define the maximum number of iterations, thereby iterating the coherence filtering for the determined number of times.

The above-described embodiment uses the coherence COH(K) as feature quantity for determining whether the iteration is to be continued or terminated. Alternatively, the determination on whether or not the iteration is to be continued may be made by using, instead of the coherence COH(K), another feature quantity having a concept of "the amount of target voice in an input voice signal".

In the above-described embodiments, particularly in the first embodiment, the processing performed on frequency domain signals may alternatively be conducted on time domain signals where feasible.

The above-described embodiments are configured in such a way that a signal picked up by a pair of microphones is immediately processed. However, the target voice signal for the processing according to the present invention may not be limited to those signals. For example, the present invention can be applied for processing a pair of voice signals read out from a storage medium. Moreover, the present invention can be applied for processing a pair of voice signals transmitted from other devices communicably connected to the device of the present invention. In such modifications of the embodiments, incoming signals may already have been transformed into frequency domain signals when the signals are input into the signal processor.

The above-described embodiments are configured to be applied to two-channel input, but may not be limited thereto, and thus the number of channels can be defined arbitrarily.

The entire disclosure of Japanese patent application No. 2013-036331 filed on Feb. 26, 2013, including the specification, claims, accompanying drawings and abstract of the disclosure, is incorporated herein by reference in its entirety.

While the present invention has been described with reference to the particular illustrative embodiments, it is not to be restricted by the embodiments. It is to be appreciated that those skilled in the art can change or modify the embodiments without departing from the scope and spirit of the present invention.

What is claimed is:

1. A signal processor, comprising:

a filtering processor configured to iteratively filter an input signal in a frequency domain containing a voice component and a noise component; and an iteration controller configured to control the iterations of the filtering of the filtering processor until a characteristic of coherence filter coefficients thereof satisfies a condition for terminating the iterations to thereby suppress the noise component in a filtered signal that is filtered by the filtering processor.

2. The processor in accordance with claim 1, wherein said iteration controller includes iteration termination determining means for determining whether or not the filtering is to be terminated, said iteration termination determining means calculating the coherence filter coefficients of each frequency component of the filtered signal for each iteration of the filtering as the characteristic of the coherence filter coefficients, and determining, when a representative value of a distribution of the coherence filter coefficients satisfies the condition for terminating the iterations, that the filtering is to be terminated.

3. The processor in accordance with claim 2, wherein the representative value is an average value of the coherence filter coefficients, and said iteration termination determining means determines that the filtering is to be terminated in an iteration in which the average value turns from increment to decrement.

4. The processor in accordance with claim 3, wherein said iteration termination determining means compares an average value of the coherence filter coefficients obtained from a current iteration with an average value of the coherence filter coefficients obtained from a previous iteration, and determines on the basis of a comparison result whether or not the filtering is to be terminated.

5. The processor in accordance with claim 3, wherein said iteration termination determining means utilizes an inclination of a variation of the average value as the characteristic of the coherence filter coefficients to determine whether or not the filtering is to be terminated.

6. The processor in accordance with claim 2, wherein the representative value is a median value of the coherence filter coefficients.

7. The processor in accordance with claim 2, wherein the iteration termination determining mean utilizes a coherence filter coefficient of a median frequency component in iterations before and after a current iteration.

8. A signal processing method of a signal processor having a filtering processor for performing coherence filtering to suppress a noise component contained in an input voice signal in frequency domain, said method comprising:

a step of executing the coherence filtering on the input voice signal by the filtering processor;

a step of iterative coherence filtering for executing the coherence filtering again on a signal obtained by the coherence filtering such that the coherence filtering is iterated until a characteristic of the coherence filter coefficients satisfies a condition for terminating the iterations to thereby suppress the noise component in a filtered signal that is performed the coherence filtering.

9. The signal processing method in accordance with claim 8, wherein the coherence filter coefficients are calculated, for each frequency component of the filtered signal for each iteration of the filtering process, and when a representative value of a distribution of the coherence filter coefficients satisfies the condition for terminating the iterations, the filtering is determined to be terminated in the iterations.

10. The signal processing method in accordance with claim 9, wherein the representative value is an average value of the coherence filter coefficients of each frequency component, and the filtering is determined to be terminated in an iteration in which the average value turns from increment to decrement.

* * * * *